US006948406B1

(12) United States Patent
Li

(10) Patent No.: US 6,948,406 B1
(45) Date of Patent: Sep. 27, 2005

(54) RATCHET WRENCH HAVING POSITIONING EFFECT

(76) Inventor: Yi Min Li, No. 62, Renmei Rd., Dali City, Taiping City, Taichung County (TW) 411

( * ) Notice: Subject to any disclaimer, the term of this patent is extended or adjusted under 35 U.S.C. 154(b) by 0 days.

(21) Appl. No.: 10/837,568

(22) Filed: May 4, 2004

(51) Int. Cl.[7] ..... B25B 13/46
(52) U.S. Cl. ..... 81/63.2; 60/61
(58) Field of Search ..... 81/63.2, 60, 61, 81/62, 63.1

(56) References Cited

U.S. PATENT DOCUMENTS 6,752,046 B1 * 6/2004 Lee ..... 81/60

* cited by examiner

*Primary Examiner*—Joseph J. Hail, III
*Assistant Examiner*—Alvin J. Grant
(74) *Attorney, Agent, or Firm*—Bacon & Thomas PLLC

(57) ABSTRACT

A ratchet wrench includes a wrench body, a ratchet wheel, a cover, and a positioning device mounted between the cover and the wrench body. The positioning device includes a locking plate, a push plate, and an elastic plate. Thus, the locking portion of the locking plate is extended into the through hole of the cover and detachably locked in the annular groove of the socket to lock the socket on the cover, so that the socket is positioned on the wrench body rigidly and stably without detachment, thereby facilitating a user operating the wrench body and the socket to rotate a workpiece, such as a nut, bolt or the like.

9 Claims, 4 Drawing Sheets

RATCHET WRENCH HAVING POSITIONING EFFECT

BACKGROUND OF THE INVENTION

1. Field of the Invention

The present invention relates to a ratchet wrench, and more particularly to a ratchet wrench having a rigid positioning effect.

2. Description of the Related Art

A conventional ratchet wrench comprises a wrench body having an end formed with a receiving hole, a ratchet wheel rotatably mounted in the receiving hole of the wrench body, and a socket mounted in the ratchet wheel. The socket is mounted on a workpiece, such as a nut, bolt or the like. Thus, the workpiece is rotated by the socket by rotation of the wrench body. However, the socket is not combined with the ratchet wheel rigidly and stably, so that the socket is easily detached from the ratchet wheel during operation, thereby causing inconvenience to a user when operating the wrench body and the socket to rotate the workpiece.

SUMMARY OF THE INVENTION

The present invention is to mitigate and/or obviate the disadvantage of the conventional ratchet wrench.

The primary objective of the present invention is to provide a ratchet wrench having a rigid positioning effect.

Another objective of the present invention is to provide a ratchet wrench, wherein the locking portion of the locking plate is extended into the through hole of the cover and detachably locked in the annular groove of the socket to lock the socket on the cover, so that the socket is positioned on the wrench body rigidly and stably without detachment, thereby facilitating a user operating the wrench body and the socket to rotate a workpiece, such as a nut, bolt or the like.

A further objective of the present invention is to provide a ratchet wrench, wherein the socket is positioned on and detached from the wrench body easily and conveniently by action of the positioning device, thereby facilitating the user operating the ratchet wrench.

In accordance with the present invention, there is provided a ratchet wrench, comprising:

- a wrench body having an end formed with a receiving hole;
- a ratchet wheel rotatably mounted in the receiving hole of the wrench body;
- a cover mounted on the wrench body and formed with a through hole communicating with the receiving hole of the wrench body; and
- a positioning device mounted between the cover and the wrench body and including:
- a locking plate slidably mounted on the cover and having a first side formed with a locking portion extended into the through hole of the cover,
- a push plate movably mounted on the cover and having a first end connected with a second side of the locking plate to move the locking plate therewith and a second end protruded outward from the cover; and
- an elastic plate mounted on the cover and urged on the push plate.

Further benefits and advantages of the present invention will become apparent after a careful reading of the detailed description with appropriate reference to the accompanying drawings.

DETAILED DESCRIPTION OF THE INVENTION

Figure 1:
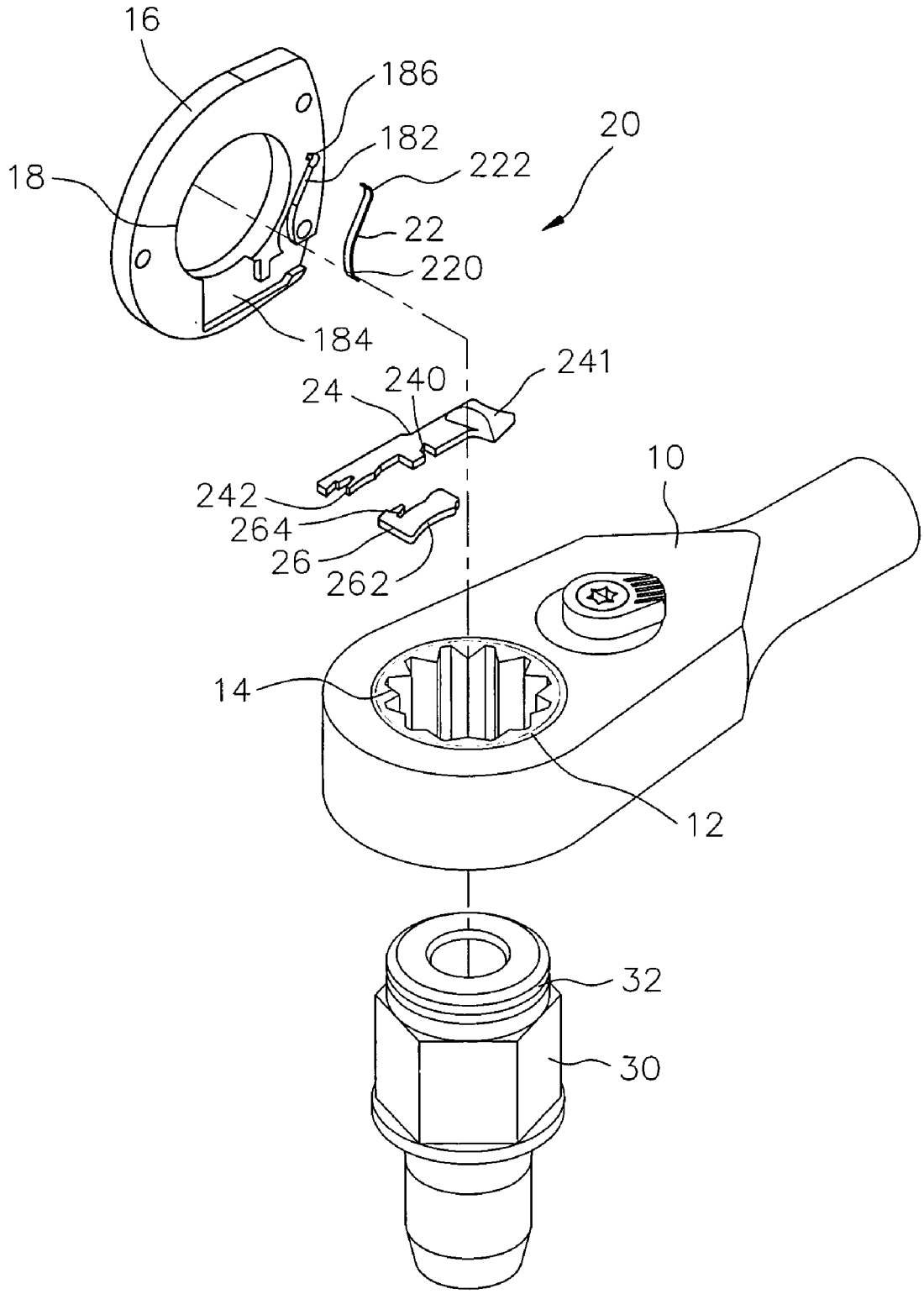
FIG. 1 is a partially cut-away exploded perspective view of a ratchet wrench in accordance with the preferred embodiment of the present invention.
Figure 2:
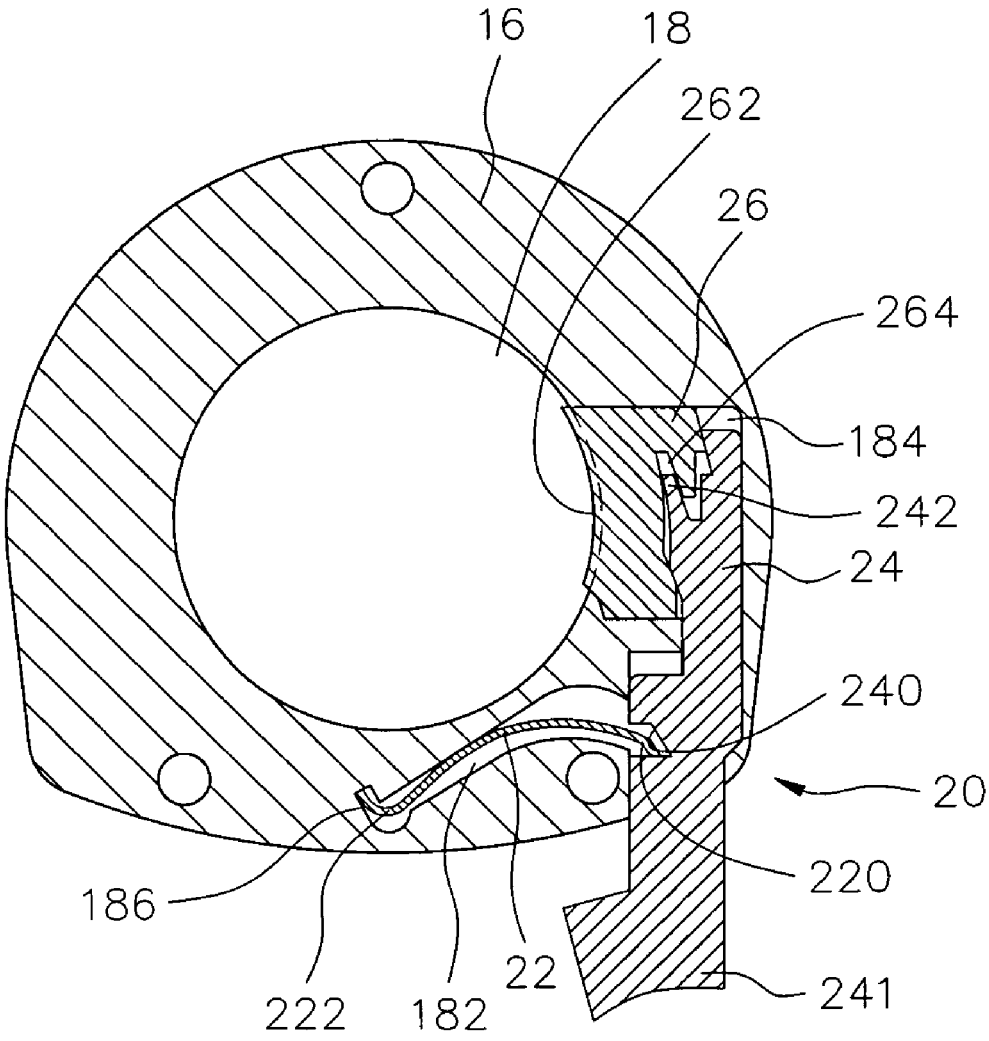
FIG. 2 is a plan cross-sectional assembly view of the ratchet wrench as shown in FIG. 1.

Referring to the drawings and initially to FIGS. 1 and 2, a ratchet wrench in accordance with the preferred embodiment of the present invention comprises a wrench body 10 having an end formed with a receiving hole 12, a ratchet wheel 14 rotatably mounted in the receiving hole 12 of the wrench body 10, a cover 16 mounted on the wrench body 10 and formed with a through hole 18 communicating with the receiving hole 12 of the wrench body 10, a socket 30 mounted in the ratchet wheel 14 and having an end extended into the through hole 18 of the cover 16 and formed with an annular groove 32 communicating with the through hole 18 of the cover 16, and a positioning device 20 mounted between the cover 16 and the wrench body 10 and locked on the socket 30 to position the socket 30 on the wrench body 10.

The positioning device 20 includes a locking plate 26 slidably mounted on the cover 16 and having a first side formed with an arc-shaped locking portion 262 extended into the through hole 18 of the cover 16 and detachably locked in the annular groove 32 of the socket 30 to lock the socket 30 on the cover 16, a push plate 24 movably mounted on the cover 16 and having a first end connected with a second side of the locking plate 26 to move the locking plate 26 therewith and a second end protruded outward from the cover 16, and an elastic plate 22 mounted on the cover 16 and urged on the push plate 24.

The cover 16 has a side formed with a receiving chamber 184 communicating with the through hole 18 and an arc-shaped channel 182 communicating with the receiving chamber 184 and located beside the through hole 18. The channel 182 of the cover 16 has a distal end formed with a retaining recess 186.

The locking plate 26 is mounted in the receiving chamber 184 of the cover 16. The second side of the locking plate 26 is formed with a tapered urging slot 264.

The push plate 24 is mounted in the receiving chamber 184 of the cover 16. The first end of the push plate 24 is formed with a tapered urging portion 242 received in the urging slot 264 of the locking plate 26 and urged on a wall of the urging slot 264 of the locking plate 26 to move the locking plate 26 outward relative to the cover 16 to detach the locking portion 262 of the locking plate 26 from the through hole 18 of the cover 16. The second end of the push plate 24 is formed with a push portion 241. The push plate 24 has a mediate portion formed with a cavity 240.

The elastic plate 22 is substantially arc-shaped and is mounted in the channel 182 of the cover 16. The elastic plate 22 has a first end 220 urged on the push plate 24 and received in the cavity 240 of the push plate 24. The elastic plate 22 has a second end formed with a hook portion 222 locked in the retaining recess 186 of the channel 182 of the cover 16, so that the elastic plate 22 is retained in the channel 182 of the cover 16.

Figure 3:
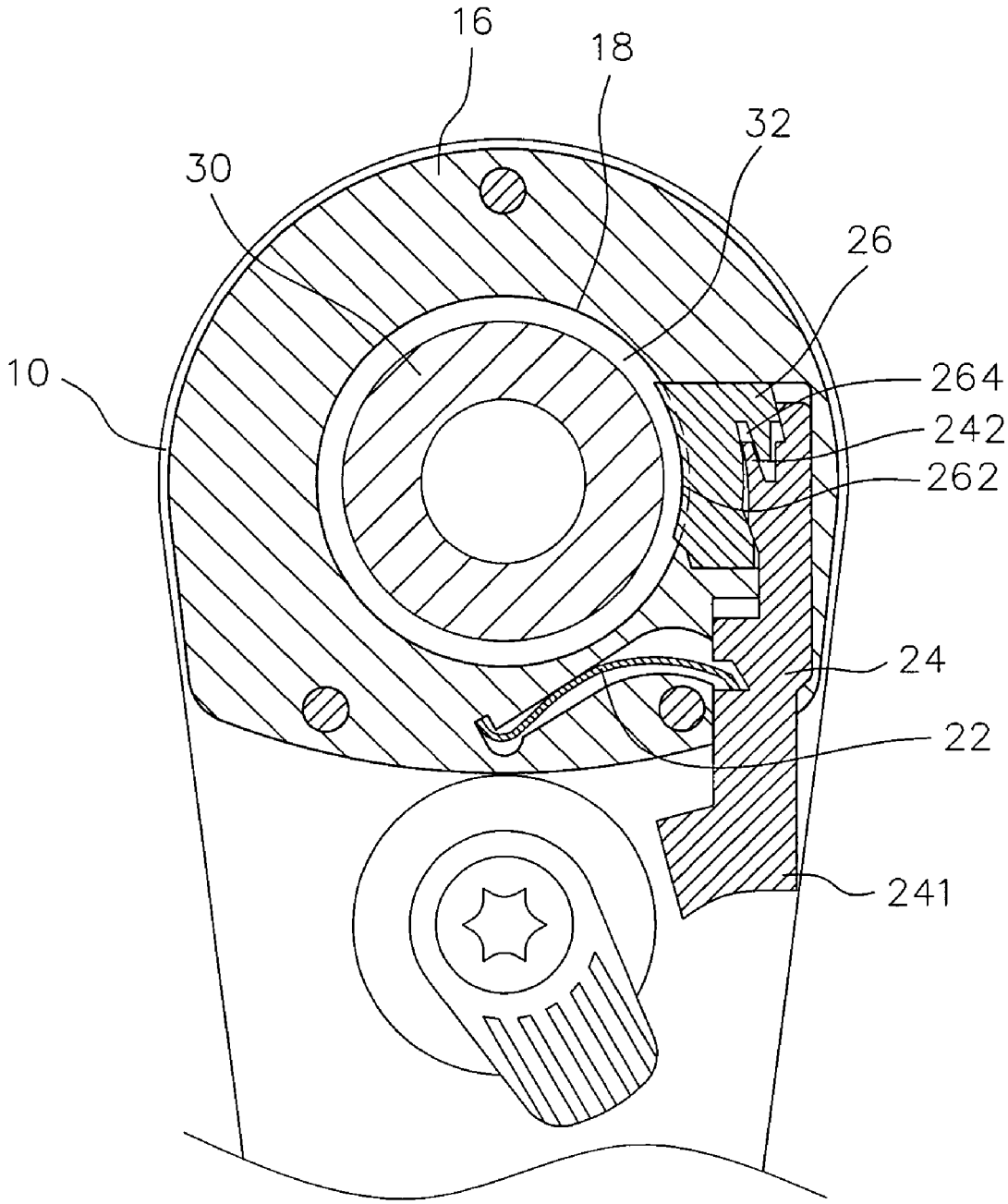
FIG. 3 is a schematic operational view of the ratchet wrench as shown in FIG. 2.

As shown in FIG. 3, the end of the socket 30 is extended into the through hole 18 of the cover 16, with its annular groove 32 communicating with the through hole 18 of the cover 16. At this time, the locking portion 262 of the locking plate 26 is extended into the through hole 18 of the cover 16 and detachably locked in the annular groove 32 of the socket 30 to lock the socket 30 on the cover 16, so that the socket 30 is positioned on the wrench body 10 rigidly and stably without detachment, thereby facilitating a user operating the wrench body 10 and the socket 30 to rotate a workpiece, such as a nut, bolt or the like.

Figure 4:
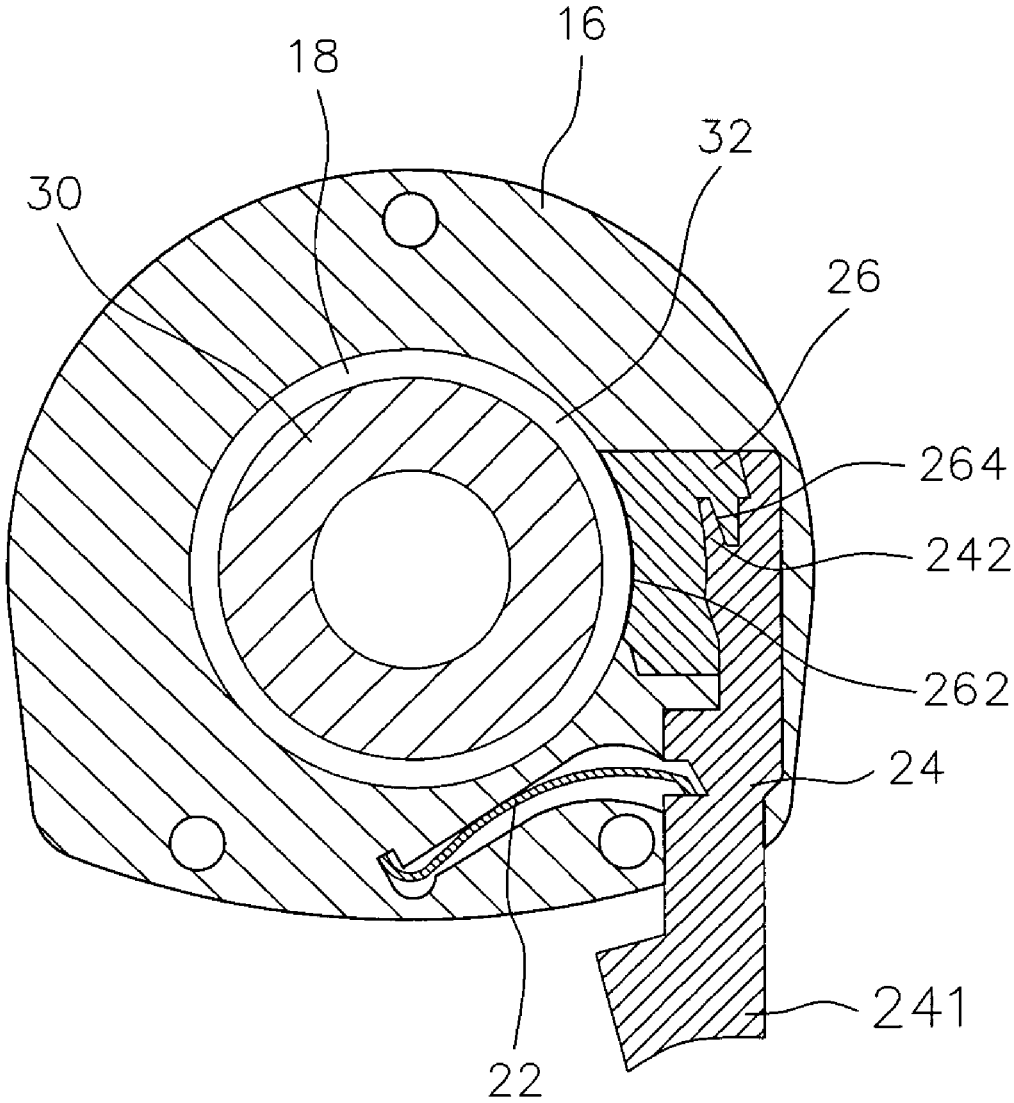
FIG. 4 is a schematic operational view of the ratchet wrench as shown in FIG. 3.

As shown in FIG. 4, the push portion 241 of the push plate 24 is pressed by the user to move the push plate 24 toward the locking plate 26, so that the urging portion 242 of the push plate 24 is urged on the urging slot 264 of the locking plate 26 to move the locking plate 26 outward relative to the cover 16 to detach the locking portion 262 of the locking plate 26 from the through hole 18 of the cover 16, thereby detaching the locking portion 262 of the locking plate 26 from the annular groove 32 of the socket 30, such that the socket 30 can be removed from the wrench body 10 when not in use.

After the force applied on the push portion 241 of the push plate 24 is removed, the push plate 24 is returned to the original position by the restoring force of the elastic plate 22, and the locking plate 26 is returned to the original position as shown in FIG. 2, so that the locking portion 262 of the locking plate 26 is extended into the through hole 18 of the cover 16.

Accordingly, the locking portion of the locking plate is extended into the through hole of the cover and detachably locked in the annular groove of the socket to lock the socket on the cover, so that the socket is positioned on the wrench body rigidly and stably without detachment, thereby facilitating a user operating the wrench body and the socket to rotate a workpiece, such as a nut, bolt or the like. In addition, the socket is positioned on and detached from the wrench body easily and conveniently by action of the positioning device, thereby facilitating the user operating the ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising:

a wrench body having an end formed with a receiving hole;

a ratchet wheel rotatably mounted in the receiving hole of the wrench body;

a cover mounted on the wrench body and formed with a through hole communicating with the receiving hole of the wrench body; and a positioning device mounted between the cover and the wrench body and including:

a locking plate slidably mounted on the cover and having a first side formed with a locking portion extended into the through hole of the cover, a push plate movably mounted on the cover and having a first end connected with a second side of the locking plate to move the locking plate therewith and a second end protruded outward from the cover; and an elastic plate mounted on the cover and urged on the push plate.

2. The ratchet wrench in accordance with claim 1, wherein the locking portion of the locking plate is substantially arc-shaped.

3. The ratchet wrench in accordance with claim 1, wherein the cover has a side formed with a receiving chamber communicating with the through hole and a channel communicating with the receiving chamber and located beside the through hole, the locking plate is mounted in the receiving chamber of the cover, the push plate is mounted in the receiving chamber of the cover, and the elastic plate is mounted in the channel of the cover.

4. The ratchet wrench in accordance with claim 3, wherein the channel of the cover is substantially arc-shaped.

5. The ratchet wrench in accordance with claim 3, wherein the channel of the cover has a distal end formed with a retaining recess, the push plate has a mediate portion formed with a cavity, and the elastic plate has a first end urged on the push plate and received in the cavity of the push plate and a second end formed with a hook portion locked in the retaining recess of the channel of the cover, so that the elastic plate is retained in the channel of the cover.

6. The ratchet wrench in accordance with claim 1, wherein the second side of the locking plate is formed with a tapered urging slot, and the first end of the push plate is formed with a tapered urging portion received in the urging slot of the locking plate and urged on a wall of the urging slot of the locking plate to move the locking plate outward relative to the cover to detach the locking portion of the locking plate from the through hole of the cover.

7. The ratchet wrench in accordance with claim 1, wherein the second end of the push plate is formed with a push portion.

8. The ratchet wrench in accordance with claim 1, wherein the elastic plate is substantially arc-shaped.

9. The ratchet wrench in accordance with claim 1, further comprising a socket mounted in the ratchet wheel and having an end extended into the through hole of the cover and formed with an annular groove communicating with the through hole of the cover, wherein the locking portion of the locking plate is detachably locked in the annular groove of the socket to lock the socket on the cover.

* * * * *